US006079380A

United States Patent [19]

Jorgensen et al.

[11] Patent Number: 6,079,380

[45] Date of Patent: Jun. 27, 2000

[54] ELECTRONICALLY CONTROLLED LUBRICATING OIL AND FUEL BLENDING SYSTEM

[75] Inventors: Robert A. Jorgensen; Steven R. Butler; Hugh M. Daugherty, all of Columbus, Ind.

[73] Assignee: Cummins Engine Company, Inc., Columbus, Ind.

[21] Appl. No.: 09/165,153

[22] Filed: Oct. 2, 1998

[51] Int. Cl.[7] ..... F01M 1/00

[52] U.S. Cl. ..... 123/73 AD; 123/1 A; 123/196 R

[58] Field of Search ..... 123/73 AD, 196 R, 123/1 A

[56] References Cited

U.S. PATENT DOCUMENTS

| | | | |
|---|---|---|---|
| 3,447,636 | 6/1969 | Bonfilio . | |
| 4,121,631 | 10/1978 | Jones . | |
| 4,262,710 | 4/1981 | Nomura et al. . | |
| 4,369,743 | 1/1983 | Holt et al. | 123/196 S |
| 4,402,351 | 9/1983 | Momura et al. . | |
| 4,403,578 | 9/1983 | Iwai et al. . | |
| 4,417,561 | 11/1983 | Yasuhara . | |
| 4,421,078 | 12/1983 | Hurner . | |
| 4,495,909 | 1/1985 | Hurner . | |
| 4,596,277 | 6/1986 | Djordjevic . | |
| 4,617,879 | 10/1986 | Mori . | |
| 4,632,085 | 12/1986 | Misawa et al. | 123/73 AD |
| 4,719,881 | 1/1988 | Holtermann et al. . | |
| 4,721,072 | 1/1988 | Holterman et al. . | |
| 4,869,346 | 9/1989 | Nelson . | |
| 5,390,762 | 2/1995 | Nelson . | |
| 5,431,138 | 7/1995 | Hurner . | |
| 5,476,073 | 12/1995 | Betts . | |
| 5,575,354 | 11/1996 | Taylor . | |
| 5,749,339 | 5/1998 | Graham et al. . | |
| 5,806,472 | 9/1998 | Nelson et al. | 123/73 AD |
| 5,881,688 | 3/1999 | Graham et al. | 123/73 AD |

FOREIGN PATENT DOCUMENTS 61-160509 7/1986 Japan .

*Primary Examiner*—Tony M. Argenbright
*Assistant Examiner*—Brian Hairston
*Attorney, Agent, or Firm*—Sixbey, Friedman, Leedom & Ferguson; Charles M. Leedom, Jr.; Tim L. Brackett, Jr.

[57] ABSTRACT

An electronically controlled lube oil and fuel blending system is provided which controls the amount of lube oil delivered from an engine lube oil supply system to an engine fuel supply system based on the amount of fuel added to the fuel supply system thereby maintaining a constant lube oil/fuel ratio or lube oil concentration in the fuel supply system 16 regardless of variations in engine operation thereby minimizing emissions, such as particulate matter. The system includes a lube oil injection circuit connecting the engine lube oil supply system to the fuel supply system and an emission compliance lube oil concentration control system for controlling a lube oil concentration in the fuel supply system to maintain compliant engine emissions during engine operation. Emission compliance lube oil concentration control system includes a lube oil injection control device for controllably delivering a predetermined quantity of used lube oil from the engine sump to the fuel supply system and a fuel supply sensing device for sensing the amount of fuel added to a fuel tank during a fuel supply period. Fuel supply sensing device 32 may include a flow meter positioned in supply pipe or a level sensing device for sensing the change in the fuel level in the tank during the supply period. The system may also include a makeup lube oil supply system for supplying additional, i.e. fresh, lube oil to engine lube oil supply system to maintain the quantity and quality of the lube oil in the engine.

16 Claims, 2 Drawing Sheets

ELECTRONICALLY CONTROLLED LUBRICATING OIL AND FUEL BLENDING SYSTEM

TECHNICAL FIELD

This invention relates to an electronically controlled system for automatically blending an engine's used lubricating oil with the engine fuel to maintain an acceptable lube oil concentration in the fuel regardless of operating conditions.

BACKGROUND OF THE INVENTION

It is highly desirable to be able to minimize the amount of service required for internal combustion engines to thereby minimize the interruption in the use of the vehicle/equipment. Degradation of engine lubricating oil during engine use requires oil changing procedures which account for a significant portion of the maintenance and associated engine "down time". Conventional periodic oil changes generate an accumulation of waste lubricating oil which must be disposed of and/or processed resulting in undesirable costs. Therefore, extending oil drain intervals and reducing waste disposal are of great value to vehicle/equipment operators.

Consequently, systems have been developed for automatically changing internal combustion engine crankcase oil during engine operation. For example, U.S. Pat. No. 3,447,636 discloses a system for automatically changing engine oil while the engine is operating. The system operates to drain substantially all of the used oil from the engine immediately prior to introducing fresh oil into the engine from a reservoir. The single operation process results in a complete change of substantially the entire engine oil volume. However, draining the engine prior to refilling with fresh oil necessarily creates a risk that an inadequate supply of lube oil exists in the engine for an interim time period possibly resulting in damage or excessive wear to engine components from insufficient lubrication. Moreover, this system undesirably results in a quantity of waste oil.

Other systems have been developed which automatically change engine lube oil during engine operation while avoiding a waste quantity of oil by directing the used lube oil into the fuel system for burning with the fuel in the engine. These systems periodically drain a small amount of the used oil from the engine lube oil system, and replace the drained quantity with fresh lubricant from an auxiliary tank. One type of automatic oil changing system injects used lube oil into the fuel system at fixed time intervals preset by a time device. For example, U.S. Pat. Nos. 4,869,346 and 5,390,762 to Nelson disclose an automatic crankcase oil change and makeup system including a displacement unit having a piston with a predetermined stroke set to deliver identical, predetermined amounts of fresh oil during each stroke at the same flow rate and volume as the extraction of used oil. The frequency of the pressure strokes is set by a timer in an electronic controller, and is adjustably set to stroke at fixed time intervals to provide a cumulative quantity of fresh oil to the crankcase according to the regular recommended oil change period for the particular engine. A pair of dials on the controller enable the frequency of the pressure strokes to be adjusted. U.S. Pat. Nos. 4,421,078; 4,495,909; and 5,431,138 to Hurner disclose similar systems for oil changing and making up during engine operation which include a control module having an adjustable impulse timer set to periodically cycle an air pressure operated oil extractor pump at a fixed time intervals to direct a predetermined amount of engine oil out of the oil pan and into the fuel tank. Fresh makeup oil is pumped from an oil reservoir to the crankcase, also by air pressure, in response to a low level signal from a dipstick sensor. Similarly, U.S. Pat. No. 4,417,561 to Yasuhara discloses an automatic oil changing and disposing apparatus wherein used crankcase oil is periodically directed to a fuel tank via a valve controlled by an odometer switch, and fresh oil is gravity fed from a fresh oil tank to the crankcase via a control valve controlled by a crankcase oil level switch. The quantity of each increment of used oil removed from the crankcase, and each increment of fresh oil supplied, is controlled by respective timers having variable on-time duration to effect variable control of engine oil extraction and addition.

Injecting lubricating oil into engine fuel results in additional emissions related to the lube oil/fuel concentration or ratio. Upcoming government regulations may require emissions compliance at a "worst case" lube oil/fuel concentration during engine operation. Although capable of automatically changing lube oil during engine operation, the timer-based automatic oil changing systems discussed hereinabove inject more than an optimum amount of lube oil from the crankcase into the fuel system when the engine is being used less heavily than expected. As a result, these systems will likely result in an unacceptably high "worst case" lube oil/fuel concentration, especially when the engine is operated under sustained low load operation, rendering such systems extremely difficult, if not impossible, to certify due to extremely high particulate matter levels. Moreover, excessive concentrations of used oil in the fuel results in engine performance degradation, shortened fuel filter life and wasted oil. These timer-based systems also are likely to inject less than an optimum amount of lube oil into the fuel system when the engine is being used more heavily than expected. Injecting too little used oil from the oil sump into the fuel system will disadvantageously result in engine damage from over-used oil incapable of adequately lubricating and cooling engine components.

U.S. Pat. No. 5,749,339 discloses an electronically controlled continuous lubricating oil replacement system which injects the used engine lubricating oil into the engine fuel system during operation based on engine operating conditions. An electronic controller is provided to vary the amount of used lube oil injected into the fuel system based on the severity of engine operation. The system maintains the quality of the engine lube oil at a level necessary to provide optimal engine protection at all engine operating conditions. However, the "worst case" concentration is also several times higher than the mean concentration possibly making the engine difficult to certify under strict "worst case" standards.

Japanese Patent No. 61-160509 discloses a device for mixing lube oil in a fuel tank which delivers an amount of lube oil set at a predetermined ratio relative to the incremental weight of fuel added. The oil is delivered into the fuel filling section of the fuel tank. U.S. Pat. No. 4,617,879 to Mori discloses a level sensing system that provides a signal to control a lubricant pump so as to inject an amount of oil proportional to the fuel added. However, these systems relate to two-cycle engines and therefore do not suggest removing used oil from the engine's crankcase or lubricating oil system for injection into the fuel system. Also, these systems require the oil reservoir to be replenished manually. These references also rely only on the weight and level of the fuel added.

U.S. Pat. No. 4,596,277 to Djordjevic injects a quantity of catalyst additive in proportion to the quantity of fuel added to the fuel tank. A fuel level float opens a bellows valve as the fuel tank level increases during filling operations to supply the additive to the tank.

Therefore, there is a need for an electronically controlled engine lube oil and fuel blending system capable of automatically and effectively controlling the quantity of used lube oil injected into an engine fuel system so as to maintain a lube oil/fuel concentration within acceptable limits.

SUMMARY OF THE INVENTION

It is an object of the present invention, therefore, to overcome the disadvantages of the prior art and to provide an electronically controlled lubricating oil and fuel blending system for an engine capable of reliably, accurately and effectively controlling the quantity of used lube oil removed from the engine's lube oil system and injected into the engine fuel system.

It is another object of the present invention to provide an electronically controlled lubricating oil and fuel blending system capable of replacing the used lube oil in an engine while maintaining the lube oil ratio in the fuel at a fixed concentration; the concentration at, or below, which the certification tests were performed.

It is yet another object of the present invention to provide an electronically controlled lube oil and fuel blending system which eliminates oil changes so as to minimize engine down time.

It is a further object of the present invention to provide an electronically controlled lube oil and fuel blending system which accurately and effectively maintains the oil concentration in the engine's fuel system at a level necessary to maintain emissions compliance.

It is a still further object of the present invention to provide an electronically controlled engine lube oil and fuel blending system for replacing the lube oil in the engine oil sump which maintains the quality of the engine lube oil at a level necessary to provide optimal engine protection.

Still another object of the present invention is to provide an electronically controlled used lube oil and fuel blending system capable of promoting mixing of the lube oil and fuel.

Another object of the present invention is to provide an electronically controlled lube oil and fuel blending system which continuously monitors and maintains the engine lube oil sump at the proper level thereby eliminating the costs and risks associated with manual inspections by the vehicle operator.

Yet another object of the present invention is to provide an electronically controlled lube oil and fuel blending system which eliminates the need to dispose of used engine oil.

Still another object of the present invention is to provide an electronically controlled lube oil and fuel blending system which maintains the lube oil/fuel ratio constant.

Another object of the present invention is to provide an inexpensive electronically controlled lube oil/fuel blending system which effectively controls the quantity of used oil added to the engine fuel based on the amount of fuel added to the engine fuel tank.

Still another object of the present invention is to provide an electronically controlled lube oil and fuel blending system which maintains the "worst case" lube oil/fuel concentration equivalent to the average concentration.

It is a further object of the present invention to provide an electronically controlled lube oil and fuel blending system which maintains the quantity of particulate matter in the engine exhaust at an acceptable level.

The above objects are achieved by providing an electronically controlled lube oil and fuel blending system for removing used lube oil from an engine, comprising an engine lube oil supply for supplying lube oil to the engine, a fuel supply for supplying fuel to the engine and for periodically receiving a refill quantity of fuel, and a lube oil injection circuit connected to the lube oil supply and the fuel supply for permitting a predetermined quantity of lube oil to be delivered from the lube oil supply to the fuel supply. The blending system also includes an emission compliance lube oil concentration control means for controlling a lube oil concentration in the fuel supply to maintain compliant engine emissions during engine operation by controlling the predetermined quantity of lube oil delivered from the lube oil supply into the fuel supply. The emission compliance lube oil concentration control system includes a fuel refill sensing device for sensing the refill quantity of fuel delivered to the fuel supply and for generating a refill quantity signal based on the refill quantity. The engine compliance lube oil concentration control system further includes an engine lube oil injection control device positioned along the lube oil injection circuit for controlling the flow of lube oil in the lube oil injection circuit and a processor for receiving the refill quantity signal and generating a lube oil injection flow signal based on the refill quantity signal. The lube oil injection flow control signal controls the operation of the engine lube oil injection control device to define the predetermined quantity of lube oil. The fuel refill sensing device may include a flow meter. The fuel supply may include a fuel tank and a refill pipe connected to the fuel tank. In this case, the flow meter may be positioned within the refill pipe. Alternatively, the fuel refill sensing device may include a level sensing device. The engine lube oil injection control device may be in the form of a lube oil pump.

The electronically controlled lube oil and fuel blending system of the present invention may also include a makeup lube oil supply system including a makeup lube oil tank, and makeup supply circuit connecting the makeup lube oil tank to the engine lube oil supply and a makeup lube oil control device positioned along the makeup supply circuit or controlling the makeup supply flow of lube oil to the engine lube oil supply. The makeup lube oil control device may include a makeup lube oil pump.

Electronically controlled lube oil and fuel blending system of the present invention is especially designed for four-cycle internal combustion engines containing a lube oil sump from which lube oil is drawn and returned after delivery to the engine for lubricating the engine components. The fuel supply tank and fuel refill pipe are mounted a spaced distance from the engine body and the lube oil sump, and the lube oil supply system is fluidically separate from the fuel system.

DETAILED DESCRIPTION OF THE INVENTION

Figure 1:
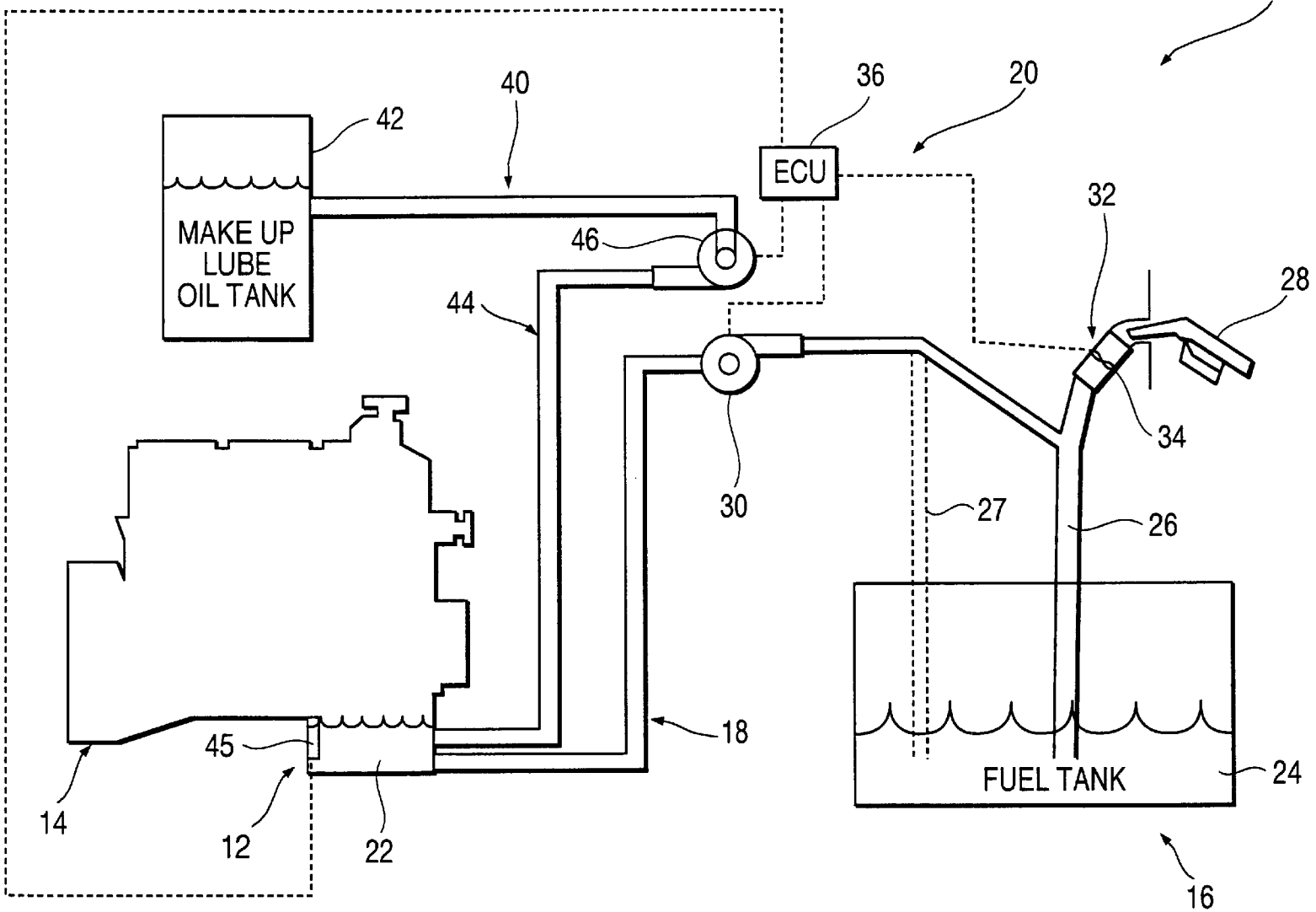
FIG. 1 is a schematic diagram of the electronically controlled lube oil and fuel blending system of the present invention.

Referring to FIG. 1, the electronically controlled lube oil and fuel blending system of the present invention, indicated generally at 10, includes an engine lube oil supply system 12 for supplying lubricating fluid or oil to an engine 14 for lubricating and cooling engine components, a fuel supply system 16 for supplying fuel to the engine, a lube oil injection circuit 18 connecting engine lube oil supply system 12 to fuel supply system 16 for permitting a predetermined quantity of lube oil to be delivered from the lube oil supply system 12 to the fuel supply system 16 and an emission compliance lube oil concentration control system for controlling a lube oil concentration in the fuel supply system to maintain compliant engine emissions during engine operation. The electronically controlled lube oil and fuel blending system functions to control the predetermined quantity of lube oil delivered from the engine lube oil supply system 12 to the fuel supply system 16 based on the amount of fuel added to the fuel supply system thereby maintaining a relatively constant lube oil/fuel ratio in the fuel supply system 16. Specifically, the present system maintains the lube oil concentration in the fuel present in fuel supply system 16 at an acceptable level regardless of variations in engine operation. As a result, the present system automatically removes used oil from the engine lube oil supply system for injection into the fuel supply system to minimize lube oil waste, minimize the cost of oil change procedures and to maintain the quality of the oil in the engine lube oil supply system while, importantly, effectively maintaining the lube oil concentration in the fuel at an acceptable level regardless of engine operating conditions thereby minimizing emissions, such as particulate matter.

The present electronically controlled lube oil and fuel blending system 10 of the present invention may be used in conjunction with any engine 14 having a lube oil supply system for supplying lubricating oil to the engine for lubricating and cooling the engine. For example, engine 14 may be a reciprocating piston type engine having any number of engine cylinders (not shown). The lube oil and fuel blending system 10 of the present invention is specifically designed to remove used lube oil from an engine having a lube oil supply system so as to assist in maintaining the quality of the lube oil at a predetermined level. Engine lube oil supply system 12 includes a lube oil sump 22 mounted below engine 14 for receiving used lube oil flowing from the engine. Fuel supply system 16 includes a fuel tank 24 for receiving fuel for delivery to engine 14 and a supply pipe 26 for delivering supply fuel to fuel tank 24. Supply pipe 26 includes one end positioned to deliver fuel into tank 24 and an opposite end for receiving fuel from, for example, a fuel nozzle 28. At various times during the operation of engine 14, the operator will determine that additional fuel should be supplied to fuel tank 24 via supply pipe 26 in order to maintain a sufficient supply of fuel in tank 24. During each of these events, fuel is delivered to fuel tank 24 via supply pipe 26 and, for example, nozzle 28, to refill supply tank 24 to a desired level.

Lube oil injection circuit 18 is connected at one end to engine lube oil supply system 12 and at an opposite end to fuel supply system 16. Preferably, lube oil injection circuit 18 is connected to lube oil sump 22 of lube oil supply system 12 so that a sufficient supply of used lube oil is available for injection into fuel supply system 16 as discussed more fully hereinbelow. The opposite end of lube oil injection circuit 18 is connected to supply pipe 26. Lube oil injection circuit 18 may alternatively be connected directly to fuel tank 24 as indicated at 27. However, in the preferred embodiment, lube oil injection circuit 18 is connected to supply pipe 26 to promote mixing of the lube oil and fuel during the addition of the fuel via supply pipe 26. Of course, it should be noted that engine lube oil injection control device 30 may be operated subsequent to the time period during which fuel is added to fuel tank 24.

Emission compliance lube oil concentration control system 20 includes an engine lube oil injection control device 30 for controllably delivering a predetermined quantity of used lube oil from sump 22 to fuel supply system 16. For example, in the preferred embodiment, engine lube oil injection control device 30 is a pump, for example, a positive displacement or centrifugal pump. Of course, lube oil injection control device 30 may be any metering or pumping device capable of being selectively operated to inject a precise quantity of lube oil, such as the devices disclosed in U.S. Pat. Nos. 4,421,078; 4,495,909; and 5,431,138, the entire contents of each of which is hereby incorporated by reference. As shown in FIG. 1, emission compliance lube oil concentration control system 20 also includes a fuel supply sensing device 32 for sensing the amount of fuel added to fuel tank 24 during a fuel supply period. In the embodiment of FIG. 1, fuel supply sensing device 32 includes a flow meter 34 positioned in supply pipe 26 for sensing the amount of fuel added to tank 24 by measuring the fuel flow through supply pipe 26 during a supply period. Fuel supply sensing device 32 measures the fuel flow and generates a supply quantity signal based on the quantity of fuel supply through pipe 26 as determined by measuring the fuel flow. Emissions compliance lube oil concentration control system 20 further includes an electronic processor, i.e. electronic control unit (ECU), for receiving the supply quantity signal from fuel supply sensing device 32 and generating a lube oil injection flow control signal based on the supply quantity signal. The lube oil injection flow control signal is delivered to lube oil injection control device 30 for controlling the operation of lube oil injection control device 30 so as to define a predetermined quantity of lube oil to be delivered based on the quantity of fuel delivered through supply pipe 26. Thus, processor 36 causes lube oil injection control device 30 to operate only for a period of time necessary to deliver a predetermined quantity of used lube oil from sump 22 to supply pipe 26 for delivery to fuel tank 24. The controlled amount of lube oil injected into fuel supply system 16 is precisely controlled based on the amount of fuel added during a given supply period so as to result in a total quantity of fuel in the fuel supply system 16 having an acceptable lube oil concentration level. By effectively controlling the lube oil concentration level in the fuel based on the amount of fuel added, the engine emissions can be maintained in compliance with regulatory requirements. Thus, the emission compliance lube oil concentration control system 20 of the present invention effectively maintains the lube oil concentration, or lube oil/fuel ratio, at an acceptable level throughout engine operation, regardless of varying engine operating conditions, by removing from the lube oil system and, adding to fuel supply system 16, only a predetermined quantity of used lube oil corresponding to the amount of new fuel supplied to fuel supply system 16. That is, the quantity of used lube oil added to fuel supply system 16 during a given supply period is sufficient to raise the lube oil concentration of the quantity of fuel added during the supply period to a predetermined concentration level or lube oil/fuel oil ratio corresponding to an acceptable level of emissions. Thus, regardless of engine operating conditions, the present system will maintain an average lube oil concentration in the fuel without permitting variations in the lube oil concentration from exceeding acceptable levels. In essence, the present system maintains the lube oil/fuel ratio constant throughout engine operation.

Figure 2:
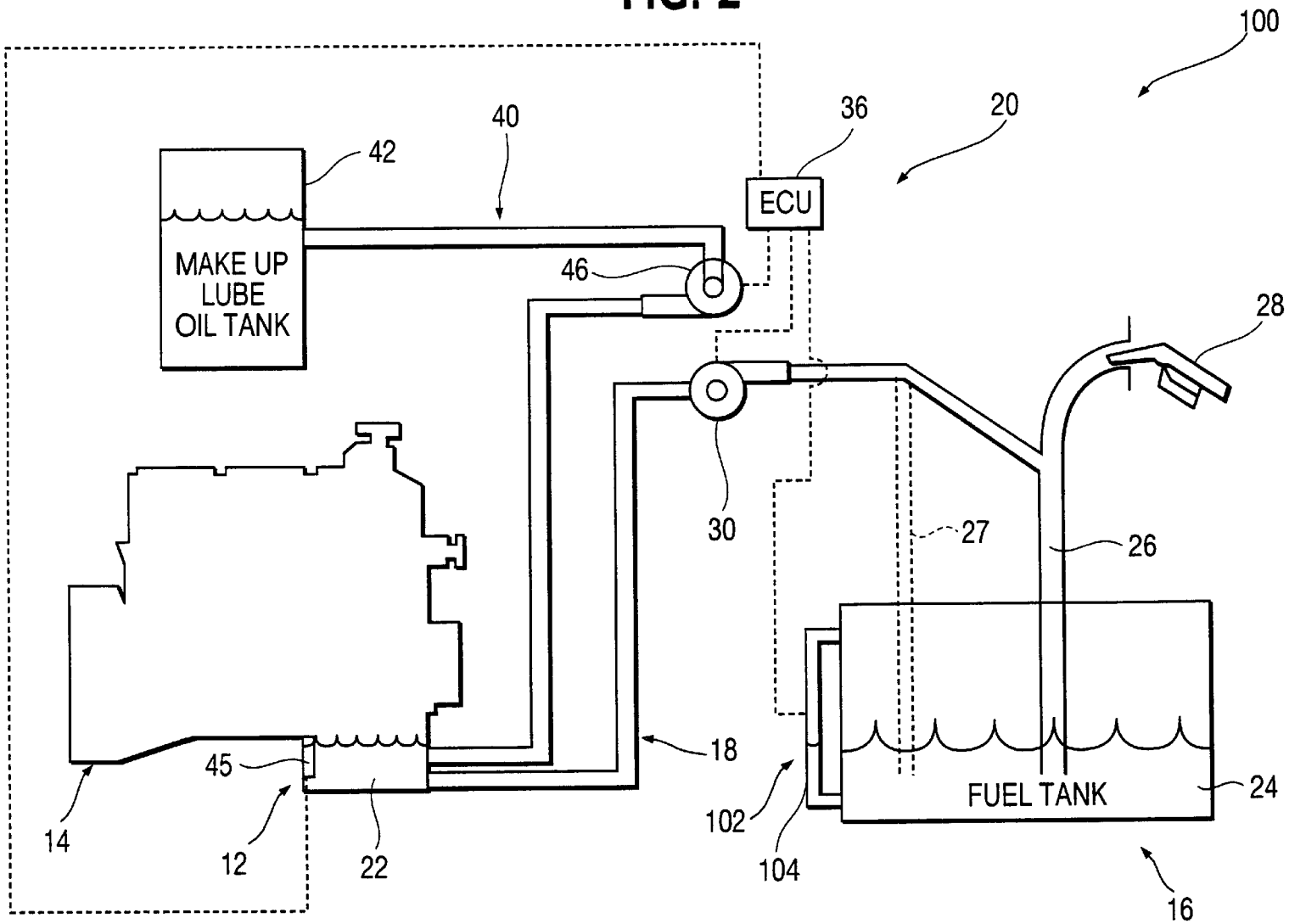
FIG. 2 is a schematic diagram of a second embodiment of the electronically controlled lube oil and fuel blending system of the present invention.

FIG. 2 illustrates a second embodiment of the electronically controlled lube oil and fuel blending system of the present invention, indicated generally at 100, which is the same as the previous embodiment shown in FIG. 1 except that a fuel supply sensing device 102 includes a level sensing device 104 for sensing the fuel level in tank 24. Level sensing device 104 senses the change in the fuel level which occurs during a supply period or filling operation and generates a supply quantity signal based on the fuel level change in tank 24. The processor 36 receives the supply quantity signal and generates a lube oil injection flow control signal based on the supply quantity signal, i.e. fuel level change signal, for controlling the operation of engine lube oil injection control device 30. Level sensing device 104 may be any conventional level sensing device capable of detecting the change in the level of fuel in a tank and generating a signal based on the level change. The operation of the embodiment of FIG. 2 is substantially the same as described hereinabove with respect to the embodiment of FIG. 1.

As shown in FIG. 1, electronically controlled lube oil and fuel blending system 10 may also include a makeup lube oil supply system indicated generally at 40 for supplying additional, i.e. fresh, lube oil to engine lube oil supply system 12. Makeup lube oil supply system 40 includes a makeup lube oil tank 42 containing a reserve or makeup supply of lube oil and a makeup lube oil supply circuit 44 fluidically connecting tank 42 to lube oil sump 22. The system 40 further includes a makeup lube oil flow control device 46 for controlling the flow of makeup oil to sump 22. Makeup lube oil flow control device 46 is preferably the same type of pump as engine lube oil injection control device 30 described hereinabove. Upon receipt of an actuation signal from processor 36, makeup lube oil flow control device 46 operates to deliver a fixed quantity of makeup lube oil. The lube oil level in sump 22 is monitored during engine operation via any conventional level sensing device or system, as indicated at 45. When the oil level in sump 22 reaches a predetermined level below the normal operating level, processor 36, which receives level signals from the sump level sensors 45, actuates makeup lube oil flow control device 46 to inject or deliver makeup lube oil so as to maintain a predetermined level in sump 22. Alternatively, a float-type device may be used in combination with a gravity drain version of the present system. In this embodiment, makeup lube oil tank 42 must be positioned above sump 22 and a valve positioned in the makeup supply circuit 44 for control by the float-type device such that the valve is open when the oil level in sump 22 is low and closed when the oil level reaches an acceptable predetermined level.

Alternatively, in certain applications wherein the engine experiences intermittent use, the system may be designed to detect sump oil level only prior to each engine start-up, when the level can be accurately detected, instead of continuously or intermittently throughout engine operation. In overthe-road vehicle applications, the sump oil level may be difficult to accurately detect due to churning of the oil by the engine crankcase and vehicle movement. By only detecting sump level during engine shut-down, an accurate sump level can be detected. If the sump level is below an acceptable level, then the makeup lube oil flow control device 46 can be operated to add the necessary amount of oil to the sump.

In an alternative embodiment, the engine lube oil injection control device 30 and the makeup lube oil flow control device 46 may be integrated into a dual function flow control device which in a single operation injects the same amount of fresh oil into sump 22 and used oil from the sump into the fuel system period, that is, operation of engine lube oil injection control device 30 causes corresponding operation of makeup lube oil flow control device 46 resulting in a quantity of makeup oil being delivered to sump 22 equal to the used oil removed from sump 22 by engine lube oil injection control device 30. The dual function flow control device may, for example, be similar to that disclosed in U.S. Pat. No. 4,869,346, the entire contents of which is hereby incorporated by reference.

The present electronically controlled lube oil and fuel blending system results in several advantages over existing oil replacement systems. First, it is likely that future government regulations will require emissions compliance at the "worst case" lube oil concentration in the fuel experienced during actual operation of lube oil and fuel blending systems. One type of lube oil blending/replacement system is a timer based system wherein used oil is extracted at fixed or slightly variable intervals throughout operation. However, timer based lube oil blending systems may result in a high "worst case" lube oil concentration under sustained low load engine operation. As a result, timer based systems will likely be extremely difficult, if not impossible, to certify under future government regulations due to the extremely high emission levels resulting from the high lube oil concentration. A second type of system varies the quantity of used oil removed from the engine based on engine operating severity conditions, i.e. fuel consumption. In certain applications, these variable condition based systems may result in "worst case" lube oil concentrations several times higher than the mean lube oil concentration thereby making certification difficult. The present invention overcomes these problems by keeping the "worst case" lube oil concentration in the fuel equivalent to the average concentration. As a result, the resulting emissions from the engine are maintained in compliance with government regulations. The present system is also simple and inexpensive to manufacture and operate. In addition, the present lube oil blending system may be easily retrofit on existing engines.

INDUSTRIAL APPLICABILITY

The present electronically controlled lube oil and fuel blending system may be used in any internal combustion engine having a replaceable supply of lubricating oil which is cycled through the engine for lubricating the engine's components. However, the present system is particularly useful in a compression ignition engine of any vehicle or industrial equipment.

We claim:

1. An electronically controlled lube oil and fuel blending system for removing used lube oil from an engine, comprising:

engine lube oil supply means for supplying lube oil to the engine;

fuel supply means for supplying fuel to the engine and for periodically receiving a supply quantity of fuel;

a lube oil injection circuit connected to said lube oil supply means and said fuel supply means for permitting a predetermined quantity of used lube oil to be delivered from said lube oil supply means to said fuel supply means;

an emission compliance lube oil concentration control means for controlling a lube oil concentration in the fuel in said fuel supply means to maintain compliant engine emissions during engine operation by controlling the predetermined quantity of lube oil delivered from said lube oil supply means into said fuel supply means, said emission compliance lube oil concentration control means including a fuel supply sensing means for sensing the supply quantity of fuel delivered to said fuel supply means and for generating a supply quantity signal based on said supply quantity, an engine lube oil injection control means positioned along said lube oil injection circuit for controlling the flow of lube oil in said lube oil injection circuit, a processing means for receiving said supply quantity signal and generating a lube oil injection flow control signal based on said supply quantity signal, said lube oil injection flow control signal controlling the operation of said engine lube oil injection control means to define said predetermined quantity of lube oil.

2. The system of claim 1, wherein said fuel supply sensing means includes a flow meter.

3. The system of claim 2, wherein said fuel supply means includes a fuel tank and a supply pipe connected to said fuel tank, said flow meter being positioned within said supply pipe.

4. The system of claim 1, wherein said fuel supply sensing means includes a level sensing means.

5. The system of claim 1, wherein said engine lube oil injection control means includes a lube oil pump.

6. The system of claim 1, further including a makeup lube oil supply means for supplying a makeup supply flow of lube oil to said engine lube oil supply means.

7. The system of claim 6, wherein said makeup lube oil supply means includes a makeup lube oil tank, a makeup supply circuit connecting said makeup lube oil tank to said engine lube oil supply means and a makeup lube oil control means positioned along said makeup supply circuit for controlling said makeup supply flow of lube oil to said engine lube oil supply means.

8. The system of claim 7, wherein said makeup lube oil control means includes a makeup lube oil pump.

9. A four-cycle internal combustion engine, comprising:

an engine body;

an engine lube oil supply system for supplying lube oil to the engine for lubricating the engine, said engine lube oil supply system including a lube oil sump mounted on said engine body;

a fuel supply system for supplying fuel to the engine and for periodically receiving a supply quantity of fuel, said fuel supply system including a fuel supply tank and a fuel supply pipe, said fuel supply tank and said fuel supply pipe mounted a spaced distance from said engine body and said lube oil sump;

a lube oil injection circuit connected to said lube oil supply system and said fuel supply system for permitting a predetermined quantity of used lube oil to be delivered from said lube oil supply system to said fuel supply system;

an emission compliance lube oil concentration control system for controlling a lube oil concentration in the fuel in said fuel supply system to maintain compliant engine emissions during engine operation by controlling the predetermined quantity of used lube oil delivered from said lube oil supply system into said fuel supply system, said emission compliance lube oil concentration control system including a fuel supply sensing device for sensing the supply quantity of fuel delivered to said fuel supply system and for generating a supply quantity signal based on said supply quantity, an engine lube oil injection control device positioned along said lube oil injection circuit for controlling the flow of used lube oil in said lube oil injection circuit, a processor for receiving said supply quantity signal and generating a lube oil injection flow signal based on said supply quantity signal, said lube oil injection flow control signal controlling the operation of said engine lube oil injection control device to define said predetermined quantity of used lube oil.

10. The engine of claim 9, wherein said fuel supply sensing device includes a flow meter.

11. The engine of claim 9, wherein said fuel supply sensing device includes a level sensing device.

12. The engine of claim 9, wherein said engine lube oil injection control device includes a lube oil pump.

13. The engine of claim 9, further including a makeup lube oil supply system for supplying a makeup supply flow of lube oil to said engine lube oil supply system.

14. The engine of claim 13, wherein said makeup lube oil supply system includes a makeup lube oil tank, a makeup supply circuit connecting said makeup lube oil tank to said engine lube oil supply system and a makeup lube oil control device positioned along said makeup supply circuit for controlling said makeup supply flow of lube oil to said engine lube oil supply system.

15. The engine of claim 14, wherein said makeup lube oil control device includes a makeup lube oil pump.

16. The engine of claim 10, wherein said flow meter is positioned within said supply pipe.

* * * * *